United States Patent [19]

Smith, Jr.

[11] 4,086,691

[45] May 2, 1978

[54] ROTARY HEAT EXCHANGERS

[75] Inventor: Horace L. Smith, Jr., Richmond, Va.

[73] Assignee: Smitherm Industries, Inc., Richmond, Va.

[21] Appl. No.: 670,114

[22] Filed: Mar. 25, 1976

Related U.S. Application Data

[63] Continuation-in-part of Ser. No. 622,612, Oct. 15, 1975, abandoned.

[51] Int. Cl.[2] ..... B23P 15/26

[52] U.S. Cl. ..... 29/157.3 R; 29/401 B; 29/455 R; 34/124; 165/76; 165/89

[58] Field of Search ..... 29/157.3 R, 401 B, 401 R, 29/455; 165/89, 90, 76; 34/124

[56] References Cited

U.S. PATENT DOCUMENTS

| | | | |
|---|---|---|---|
| 2,875,985 | 3/1959 | Hold | 165/89 |
| 2,915,292 | 12/1959 | Gross | 165/89 |
| 3,080,150 | 3/1963 | Gross | 165/72 |
| 3,177,932 | 4/1965 | Smith, Jr. | 165/88 |
| 3,181,605 | 5/1965 | Smith, Jr. | 29/157.3 R |
| 3,289,315 | 12/1966 | Smith, Jr. | 34/92 |
| 3,447,599 | 6/1969 | Smith | 165/89 |
| 3,548,929 | 12/1970 | Gross | 165/76 |
| 3,625,280 | 12/1971 | Peter et al. | 165/90 |

*Primary Examiner*—C.W. Lanham
*Assistant Examiner*—Daniel C. Crane
*Attorney, Agent, or Firm*—Strauch, Nolan, Neale, Nies & Kurz

[57] ABSTRACT

Rotary heat exchangers heated by circulating a heat transfer liquid through them. Methods for upgrading the performance of conventional rotary dryers.

3 Claims, 7 Drawing Figures

ROTARY HEAT EXCHANGERS

This application is a continuation-in-part of application Ser. No. 622,612 filed Oct. 15, 1975 (now abandoned).

My companion applications Ser. Nos. 622,617 and 670,248 filed this day point out that the drawbacks of a conventional paper drying installation employing steam heated, rotary dryers can be eliminated by replacing those dryers with liquid heated, rotary heat exchangers of a character I identify by the term "equitemp."

Equitemp heat exchangers are disclosed in my prior U.S. Pat. Nos. 3,177,932 issued Apr. 13, 1965, for DRUM TYPE HEAT TRANSFER APPARATUS; 3,181,605 issued May 4, 1965, for UNIFORMLY HEATED ROTARY DRYM; and 3,228,462 issued Jan. 11, 1966, for HEAT EXCHANGE APPARATUS.

They have concentric inner and outer shells between which a heat exchange liquid is circulated to heat the outer shell. Typically, the heat exchange liquid is circulated in counterflow fashion through internested, labyrinthine flow channels defined by partitions between the inner and outer shells.

The replacement of conventional dryers with equitemp dryers can advantageously be carried out by converting the existing, steam heated dryers to dryers of the equitemp type. This conversion is made by salvaging the shells of existing dryers and replacing their internal components with the inner shell and partitions needed to form flow channels for the heat exchange liquid. Typically, these will be incorporated in an assembly with end members for the dryer and axles for rotatably supporting it to facilitate their installation in the reclaimed shell.

Steam heated dryers can be converted by the technique described above to virtually any type of equitemp construction desired — those disclosed in my previously issued, above-identified patents, for example.

However, I have now invented a new and novel equitemp construction and a method of assembly which facilitates the installation of the remaining components in the outer shell and which increases the manufacturing tolerances these components may have. This makes the conversion of a steam heated, rotary dryer to one of the equitemp type even more attractive from the economic viewpoint.

In my novel, improved, equitemp construction, the outer parts of the longitudinally extending, flow channel forming partitions are flexible and springlike and dimensioned to have an interference fit with the outer shell. This allows them to flex laterally, facilitating installation of the inner shell and partition assembly. They then tend to restore to their original shapes, producing tight fits between the partitions and the inner surface of the outer shell.

In the installation process the assembly of inner shell and partition members is rotated as it is slid into the outer shell. Because of their flexibility, the partitions offer little resistance to this spiral pattern of movement even though there is an interference fit between the partitions and the outer shell. Consequently, installation in a manner which will produce a tight partition-to-outer shell fit is a comparatively simple and correspondingly inexpensive process.

That a tight fit between the outer shell and the channel forming partitions can be obtained is an important advantage of the novel construction just described. This minimizes leakage of the heat exchange liquid from one channel to another, reducing variations in surface temperature and promoting uniform drying in those applications where the heat exchangers of the present invention are used as dryers.

In the just described and other rotary, equitemp heat exchangers separate heat exchange liquid circulation systems which span different portions of the outer shell can be readily provided. By circulating the heat transfer liquid through these systems at different rates and/or temperatures, various lateral portions of the heat exchangers can be maintained at different surface temperatures. This is important in paper drying applications, for example, as it provides a control over the reel moisture profile of the product being dried.

The technique just described is particularly useful in those modern, thirty foot and wider paper machines. In dryers of this width the moisture content of the air adjacent the central portion of the dryer typically approaches saturation; but the air at the ends of the dryer has a much lower moisture content for reasons elucidated in Lee, Moisture and Temperature Profiles Across A Paper Machine, TAPPI, August 1966, pages 107A and 108A, for example. By heating the central regions of the dryer shell to a higher temperature than the end regions, the drying rate in the central regions can be increased, offsetting the effect of the varying moisture content of the air on the reel moisture profile of the product being dried.

It will be apparent to the reader from the foregoing that one important and primary object of the present invention resides in the provision of novel, improved, rotary heat exchangers of the equitemp type.

Another important and related object of the invention resides in the provision of rotary, equitemp heat exchangers which are improvements on those disclosed in my already issued patents.

Further important, but more specific, objects of my invention reside in the provision of equitemp heat exchangers:

(1) which have uniform surface temperatures;

(2) in which, in conjunction with the preceding object, flow of the heat transfer liquid between adjacent channels is minimized;

(3) which are relatively economical to construct;

(4) which can be heated to substantially higher surface temperatures than conventional, steam heated, rotary dryers;

(5) which can be operated in a manner compensating for variations in the moisture content of ambient air across the span of the heat exchanger;

(6) in which the surface temperature can be varied in a controlled manner across the span of the heat exchanger;

(7) which, in conjunction with the preceding object, have independent flow systems in which a heat transfer liquid can be circulated at different temperatures and/or rates in different lateral regions of the heat exchanger; and (8) which have various combinations of the foregoing attributes.

A still further, specific object of the present invention resides in the provision of novel techniques for assembling equitemp heat exchangers which are economical and can, moreover, be employed to convert conventional, steam heated rotary dryers to dryers of the equitemp type.

Still other important objects and additional advantages and novel features of my invention will become apparent from the appended claims and from the ensuing detailed description and discussion of the invention taken in conjunction with the accompanying drawing in which:

Figure 1:
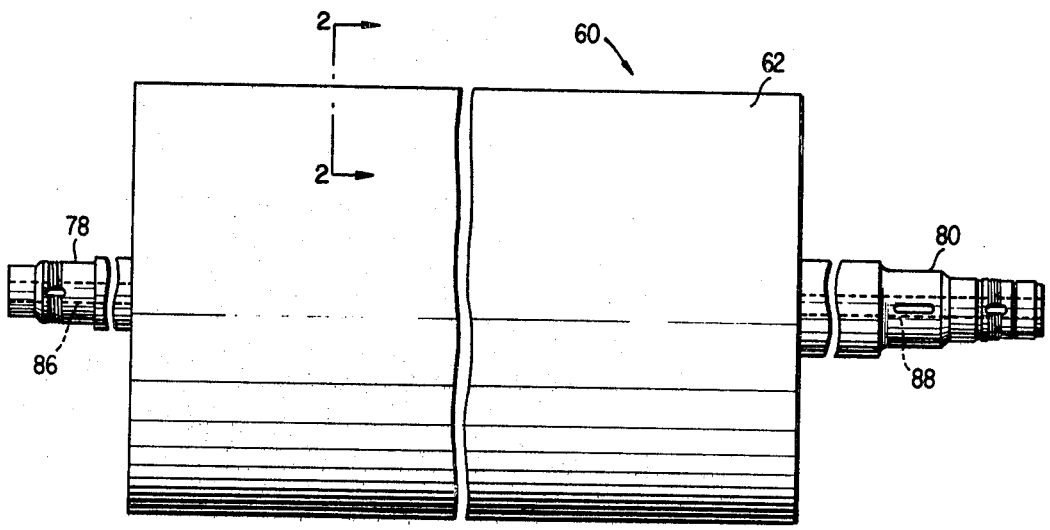
FIG. 1 is a side view of a rotary, equitemp heat exchanger constructed in accord with the principles of the present invention.

Referring now to the drawing, FIG. 1 depicts a rotary heat exchanger 60 constructed in accord with and embodying the principles of the present invention.

Heat exchanger 60 has an outer cylindrical shell 62 of heat conductive material such as cast iron and an inner cylindrical shell 64. The inner and outer shells are separated by longitudinally extending, radially oriented, partitions or dividers 66 and 68. These form passages which are connected by flow diverters 70 into internested, labyrinthine flow channels 72 and 74 (see FIG. 4). A liquid, heat transfer medium flows in opposite directions through the flow channels, effecting a substantially uniform distribution of heat to the external surface 76 of outer shell 62.

The heat exchange liquid flows to and is returned from the flow channels by a fluid supply and return system which includes hollow axles 78 and 80 extending axially from heads 82 and 84 at opposite ends of the heat exchanger. Branch supply passages 85 in head 82 connect a fluid supply passage 86 in axle 78 with flow channels 72 and 74. After circulating through these channels, the heat transfer medium flows into radially extending branch return passages 87 in head 84. At their inner ends, the branch return passages communicate with a main return passage 88 in axle 80.

As thus far described, heat exchanger 60 is constructed as shown in FIGS. 1–7 of my previously issued U.S. Pat. No. 3,228,462 which is hereby incorporated in this specification and which may be referred to by the reader for additional detail, if desired.

Figure 2:
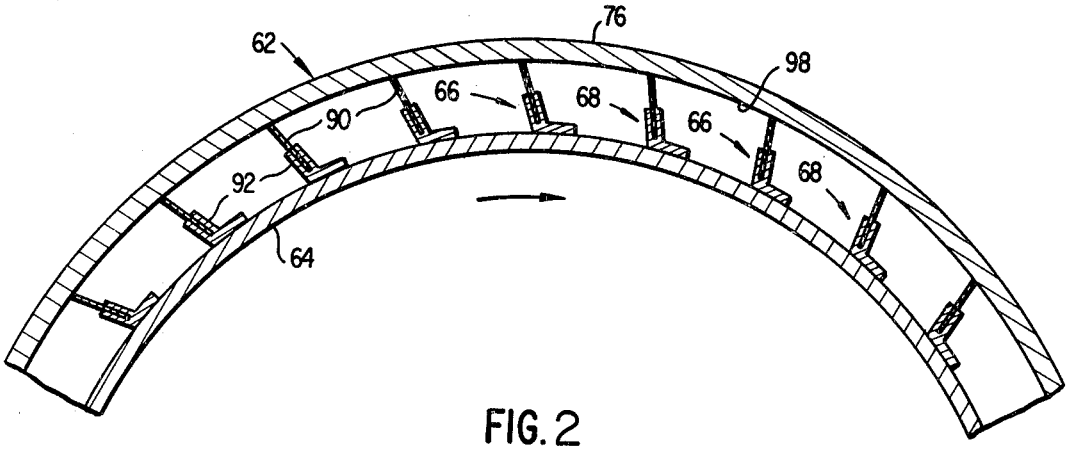
FIG. 2 is a partial section through the heat exchanger of FIG. 1 taken substantially along line 2—2 of the latter Figure.
Figure 3:
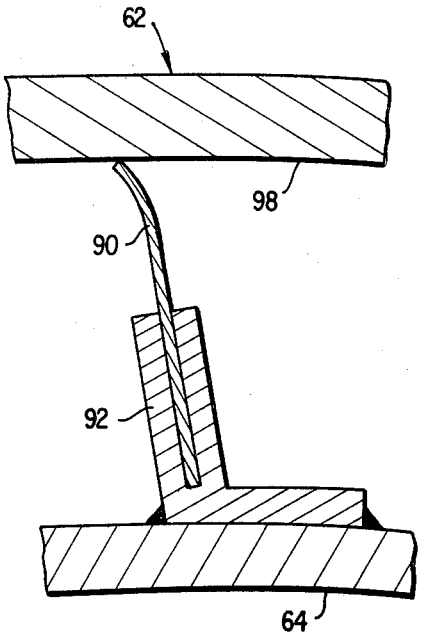
FIG. 3 is a fragment of FIG. 2 to an enlarged scale.

Heat exchanger 60 differs from that disclosed in my earlier patent primarily in the construction of channel forming partitions 66 and 68. As shown in FIGS. 2 and 3, these partitions or dividers include laterally flexible, elongated members 90 mounted in generally L-sectioned brackets 92. The latter are fixed to the inner shell 64 of the heat exchanger.

This novel divider construction is important because it facilitates assembly of the heat exchanger, yet produces a tight seal between the dividers and the outer shell. As discussed previously, this is important in that it minimizes the flow of heat transfer liquid between channels, eliminating a major source of non-uniform surface temperatures.

Figure 5:
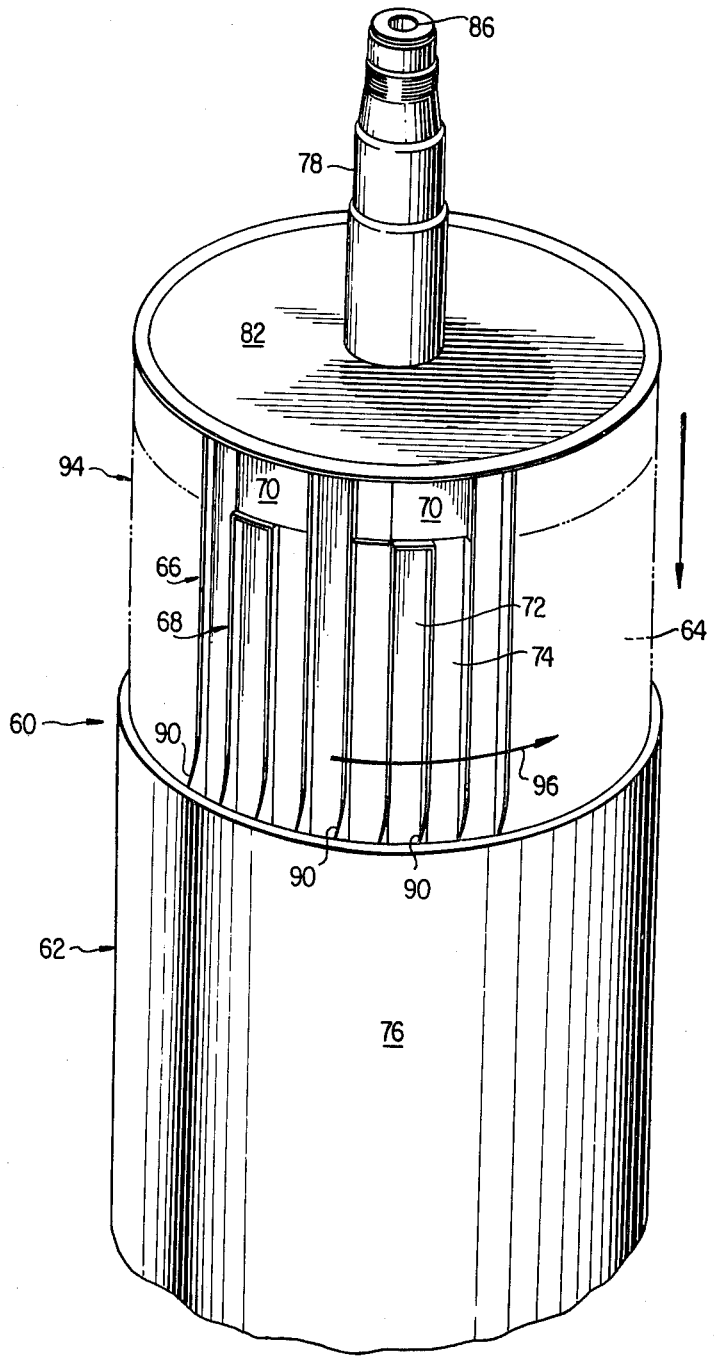
FIG. 5 is a pictorial illustration of the technique for assembling rotary, equitemp heat exchangers I have invented.

In manufacturing a heat exchanger as just described, the inner shell 64, heads 82 and 84, and channel dividers 66 and 68 plus the other internal components are assembled into a unitary system or cartridge 94. Then, as shown in FIG. 5, the assembly is simultaneously lowered or slid into outer shell 62 and rotated relative to the outer shell in the direction indicated by arrow 96. As shown pictorially in FIG. 5, this deflects the spring members 90 laterally, permitting the assembly to be easily installed.

Then, as shown in FIGS. 2 and 3, the spring members tend to restore to their original configurations. This biases them into essentially leaktight contact with the inner surface 98 of the outer shell.

Figure 6:
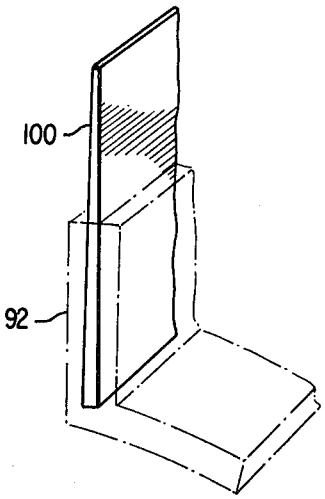
FIG. 6 is a pictorial view of a second form of partition member or flow channel divider for equitemp heat exchangers employing the principles of the present invention.

If desired, the spring action of the flexible divider components can be enhanced by employing strips with a tapered cross-section. The thicker part of the strip is fixed to the support component of the divider with the thinner, more flexible part adjacent the outer shell. A channel divider strip of this character is shown in FIG. 6 and identified by reference character 100.

The outer shell 62 of heat exchanger 60 may have been made specifically for this purpose. Or it may have been reclaimed from a conventional, steam heated dryer as indicated above.

The just described conversion of steam heated, rotary dryers to equitemp dryers is very attractive from the economic viewpoint because the bulk of the cost of a rotary dryer is in the shell. This component is typically made of 1.125–1.50 inch thick cast iron, and it must be fabricated to astonishingly close tolerances. Almost perfect balance is required in view of the 3000 feet per minute and higher surface speeds at which such dryers operate. Also, accuracy in the dimensions of the external surface is necessary to avoid the formation of wet streaks in the web being dried; and a high surface finish is necessary to keep fibers from sticking to the dryer.

It will be appreciated by those to whom this specification is addressed that the novel channel divider constructions and assembly techniques discussed above are of general applicability in the making of rotary, equitemp heat exchangers. Accordingly, it is to be understood that the relating of the foregoing to a single embodiment of the invention is not intended to limit the scope of protection to which I consider myself entitled.

I pointed out above that heat exchangers in accord with the principles of the present invention also have the advantage that, unlike steam heated rotary dryers, surface temperature can be varied across the span and that this is accomplished by providing two or more separate circulation systems for the heat transfer liquid. A heat exchanger of this character is shown in developed form in FIG. 7 and identified by reference character 178.

This particular dryer, which is designed to operate in a manner that will compensate for variations in the moisture content of the air adjacent its surface and thereby eliminate irregularities in moisture profile attributable to the varying moisture content, has three, independent, heat transfer liquid circulation systems 180, 182, and 184. The central flow system 180 spans approximately one-half the dryer and each of the two systems 182 and 184 approximately one-fourth its length. These proportions may vary from application-to-application as may the number of circulation systems.

In general, dryer 178 is of the same construction as the equitemp dryer 60 described previously. It includes an inner shell 186, an outer shell (not shown), and heads 188 and 190.

The fluid flow channels of central circulation system 180 are formed between the inner and outer shells by longitudinally extending partitions 192. Although shown as simple, rectangularly sectioned members, the longitudinally extending partitions 192 may be of the laterally deflectable, springlike character described above.

Pairs 192*a* and 192*b* of partitions extend alternately from annular partitions 194 and 196 at opposite ends of the central, liquid circulating system and terminate short of the partition at the opposite end of the central system. These partitions are dimensioned to span the gap between the inner and outer shells of dryer 178.

The longitudinally extending spaces 198*a* and 198*b* between partition pairs 192*a* and 192*b* are connected into a sinuous flow channel 200 by U-shaped fluid transfer tubes 202 at the free ends of the partition pairs. A second, internested, also sinuous flow channel 204 is formed by the spaces between the partition pairs as terminated by the transfer tubes. The heat transfer fluid is introduced into flow channels 200 and 204 through inlets 205 and 206 and discharged through outlets 207 and 208. As shown by the arrows in FIG. 7, this provides true counterflow of the liquid in the two flow channels, minimizing variations in the surface temperature of that portion of the dryer spanned by circulation system 180.

Details of the novel counterflow circulation system just described may be found in previously issued U.S. Pat. No. 3,177,932 which is hereby incorporated by reference and which may be referred to by the reader, if desired.

Also described in that patent is a system for conducting the heat transfer liquid from the exterior of the dryer to inlets 205 and 206 and for returning it to the dryer exterior from outlets 207 and 208. As a satisfactory system has heretofore been described and as the details of this system are not part of the present invention, it will not be described further herein.

Heat transfer liquid circulation system 182 extends from the left-hand head 188 of dryer 178 to partition 194. This system has two internested, sinuous flow channels 210 and 212 formed by longitudinally extending partition pairs 214*a* and 214*b* and transfer tubes 216 all connected in the same manner as the corresponding components in circulation system 180.

The heat transfer liquid is supplied to channels 210 and 212 through ports 217 and 218 and exits therefrom through discharge ports 219 and 220. The heat transfer liquid also circulates in counterflow relationship through the channels of this circulation system.

Circulation system 184, which extends between partition 196 and head 190, is constructed in the same manner as circulation systems 180 and 182. In system 184 the longitudinal partition pairs and transfer tubes are identified by reference characters 222*a* and *b* and 223, respectively. These components divide the annular space between partition 196 and head 190 into sinuous, internested flow channels 224 and 226 supplied with heat transfer liquid through ports 228 and 230. After circulating in counterflow relationship through the flow channels, the liquid exits therefrom through discharge ports 232 and 234.

Figure 7:
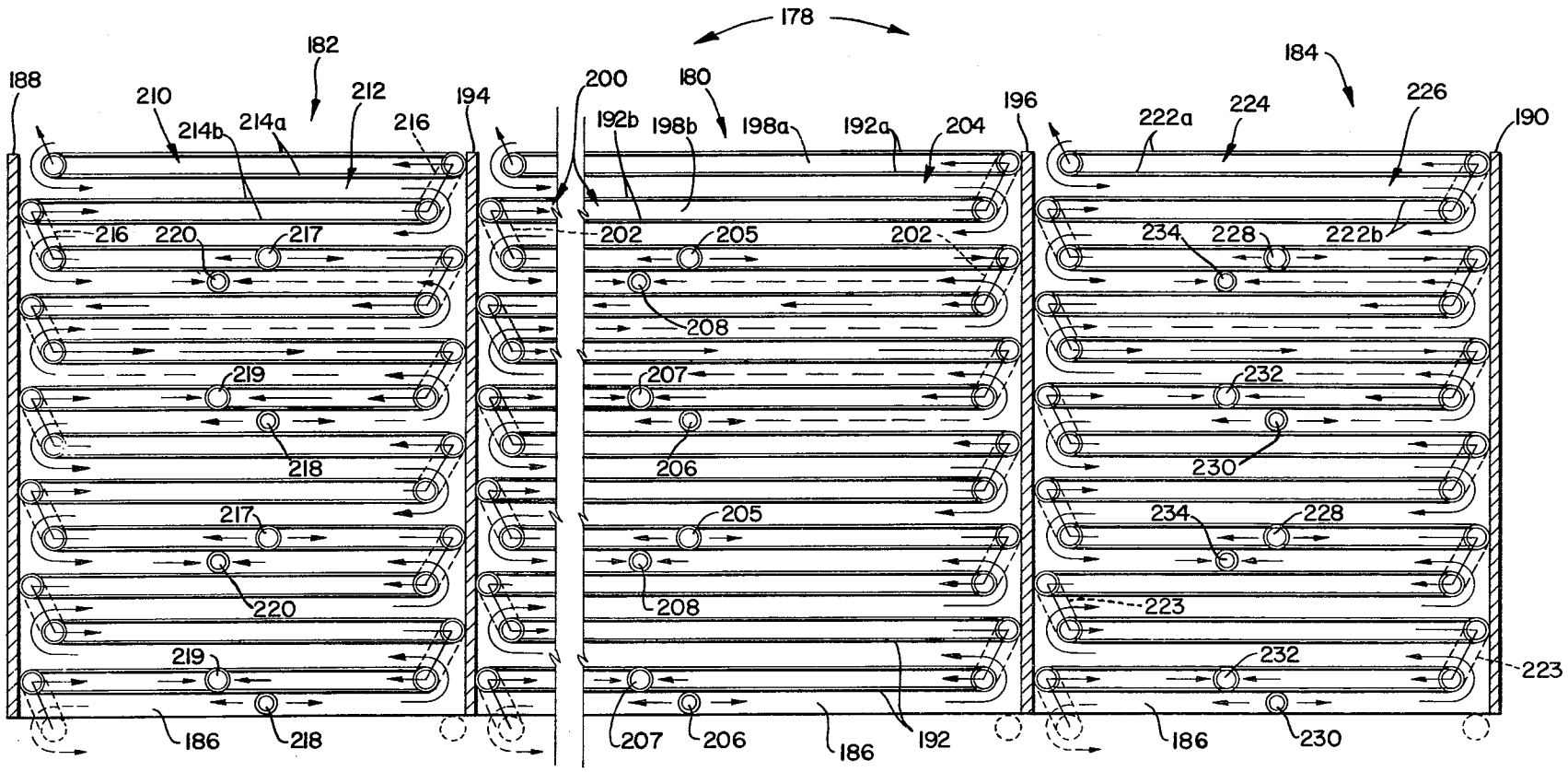
FIG. 7 is a view similar to FIG. 4 of another equitemp heat exchanger construction embodying the principles of the present invention.

The arrangement employed to supply liquid of different temperatures and/or at different rates to the circulation system of a heat exchanger as shown in FIG. 7 is not part of the present invention and will therefore not be described in detail herein. In general, however, such control may be afforded by using recirculation systems as described and shown in FIG. 3 of companion applications Ser. Nos. 622,617 and 670,248. For example, one such system may be employed to supply liquid to the central circulation system 180 of the heat exchanger and a second such system to control the temperature of the liquid flowing through the outer or end zones 182 and 184.

Figure 4:
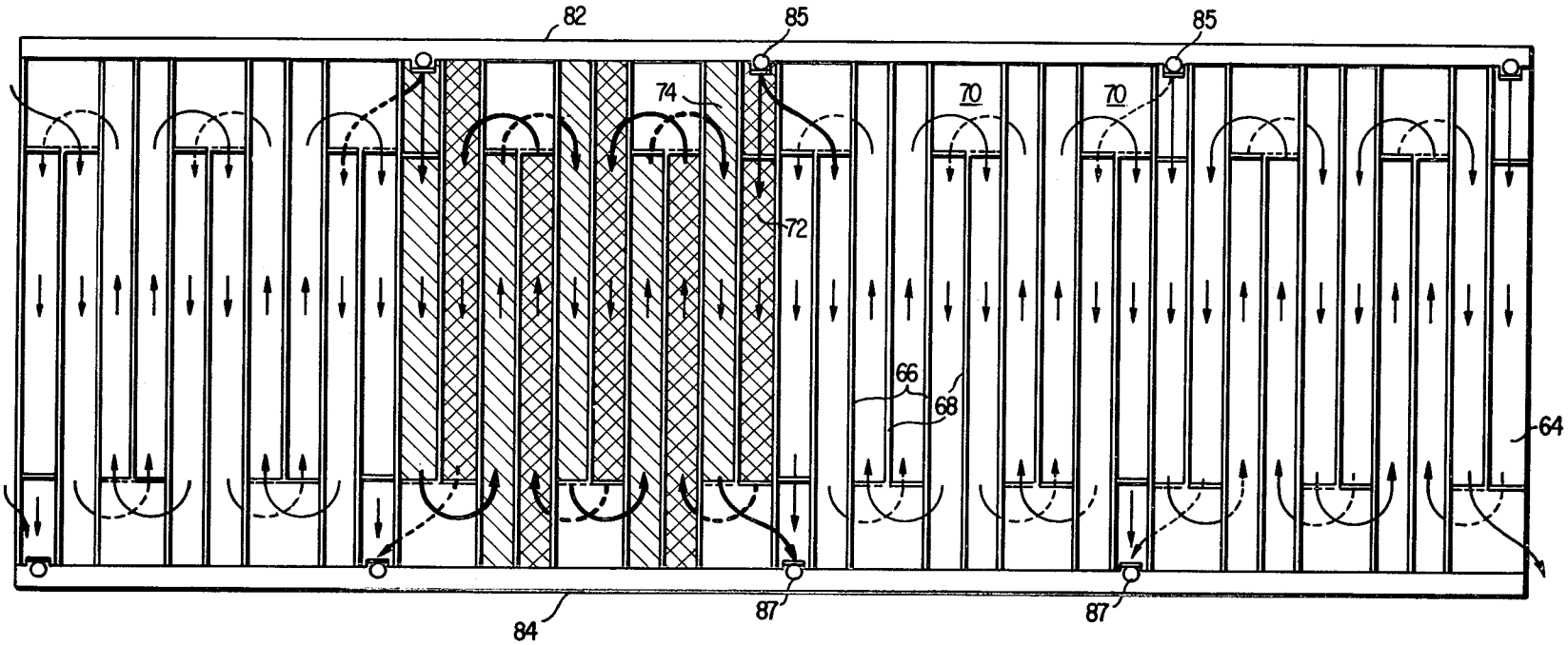
FIG. 4 is a development of the heat exchanger of FIG. 1 showing its flow channels in schematic form.

Many modifications may of course be made in the plural circulation system heat exchanger just described without exceeding the scope of the present invention. For example, the flow channels can be interconnected with diverters as shown in FIGS. 4 and 5 rather than the illustrated transverse partitions. These and other modifications are fully intended to be covered in the appended claims to the extent they are not expressly excluded therefrom.

A variety of heat exchange liquids which can be employed to heat rotary heat exchangers embodying the principles of the present invention are available. Among these is Aroclor 1248, a chlorinated biphenyl produced by Monsanto Chemical Company. Aroclor 1248 may be heated to temperatures up to on the order of 550°–570° F without exceeding a permissive rate of decomposition. In that temperature range Aroclor 1248 has a decomposition rate of less than 0.001 percent per hour of system operation.

Systems for heating the heat exchange liquids which have efficiencies comparable to those of modern steam generators are available. One heating system for such liquids is described in my U.S. Pat. No. 3,236,299 issued Feb. 22, 1966, for HIGH TEMPERATURE HEATING APPARATUS.

It will be apparent to the reader from the foregoing that the novel heat exchangers described herein can be employed to particular advantage as dryers in papermaking and other applications involving the drying of a continuous web.

However, this is by no means the only useful application of these heat exchangers. Companion applications Ser. Nos. 622,617 and 670,248, for example, point out that papermaking dryer section sweat rolls may also advantageously be of equitemp construction.

Still other applications in which these heat exchangers can be employed to advantage will readily occur to those to whom this specification is directed. To the extent these are not excluded, therefore, such applications are fully intended to be embraced within the scope of the appended claims.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A method of upgrading the performance of a rotary dryer having a cylindrical outer shell, means for supplying steam to the dryer interior to heat said shell, and means for removing condensate from the interior of the dryer, said method comprising the steps of: removing from said shell the internal components of said dryer and installing in said shell an assembly which includes an inner shell and radially extending partition means fixed to said inner shell, said partition means being cooperable with said inner and outer shells to form independent, internested flow channels through which a heat transfer liquid can be circulated in counter flow relationship to heat said outer shell and to promote uniformity in the surface temperature of said shell.

2. A method as defined in claim 1 in which at least the outer portions of said partition means are resiliently flexible and wherein said assembly is simultaneously slid into said outer shell and rotated, whereby said partitions will deflect laterally to facilitate installation of the assembly and then restore toward their original configurations, engaging the outer shell and minimizing the flow of the heat transfer liquid between the flow channels and variations in the surface temperature of the shell appurtenant to such flow between channels.

3. A method of assembling a rotary heat exchanger which has an inner shell, an outer shell, and means comprising a series of flexible and laterally deflectable partitions for dividing the space between the inner and outer shells into independent, internested flow channels through which a heat transfer liquid can be circulated in counterflow relationship to heat said outer shell and to promote uniformity in the surface temperature of said shell, said method comprising the steps of: assembling said partitions to said inner shell with said partitions extending longitudinally of and radially relative to the shell; sliding the resulting assembly into the outer shell; and simultaneously effecting relative rotation between said assembly and said outer shell to thereby deflect said partitions in a direction normal to a plane through the central axis of the inner shell and facilitate the installation of said assembly in said outer shell.

* * * * *